US006394264B2

(12) United States Patent
Riviello, Jr.

(10) Patent No.: US 6,394,264 B2
(45) **Date of Patent: *May 28, 2002**

(54) PERFUMING DEVICE FOR PERFUMING THE HEADSPACE OF A CONTAINER

(75) Inventor: Achille Riviello, Jr., Newtown, PA (US)

(73) Assignee: Firmenich SA, Geneva (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/504,861

(22) Filed: Feb. 16, 2000

Related U.S. Application Data

(60) Provisional application No. 60/123,347, filed on Mar. 5, 1999.

(51) Int. Cl.[7] ..... B65D 81/28
(52) U.S. Cl. ..... 206/213.1; 206/205; 215/261
(58) Field of Search ..... 215/261; 220/87.1, 220/228; 206/213.1, 205, 219, 524.1

(56) References Cited

U.S. PATENT DOCUMENTS 3,315,831 A * 4/1967 Scott ..... 215/261
3,521,784 A * 7/1970 Gaines et al. ..... 215/261
3,951,293 A * 4/1976 Schulz ..... 215/261
4,279,350 A * 7/1981 King ..... 215/261
4,540,721 A * 9/1985 Staller ..... 523/102
5,579,936 A * 12/1996 Costa et al. ..... 215/261
5,730,306 A * 3/1998 Costa et al. ..... 215/261

FOREIGN PATENT DOCUMENTS

| | | |
|---|---|---|
| EP | 0 258 991 | 2/1988 |
| WO | WO 94/07757 | 4/1994 |

* cited by examiner

*Primary Examiner*—Shian Luong
(74) *Attorney, Agent, or Firm*—Winston & Strawn

(57) ABSTRACT

A cap for a container housing a consumer product, in the form of a device that is capable of diffusing a volatile substance inside the container. The device includes a cap liner element for carrying the volatile substance and a barrier element, which is lodged between the cap liner element and the interior of the container. The barrier element is formed of a membrane that is permeable to the vapors of the volatile substance but impermeable to the consumer product, so as to enable molecular diffusion of the volatile substance's vapors into the headspace above the consumer product when the container is closed.

11 Claims, 1 Drawing Sheet

PERFUMING DEVICE FOR PERFUMING THE HEADSPACE OF A CONTAINER

This application claims the benefit of provisional application 60/123,347 filed Mar. 5, 1999.

BACKGROUND OF THE INVENTION AND PRIOR ART

The present invention relates to the field of perfumery. It concerns more particularly a cap (1) for a container (2) housing a consumer product, comprising a device (7, 11) capable of diffusing a volatile substance inside said container, said device being formed of a cap liner element (8, 12) carrying the volatile substance and of a barrier element (10, 14) lodged between the cap liner element and the interior of the container, wherein said barrier element is formed of a membrane permeable to the vapors of the volatile substance and impermeable to the consumer product, so as to enable molecular diffusion of the volatile substance's vapors inside the closed container.

Consumer products such as heavy-duty detergents and bleaches, which typically may contain chlorine-releasing agents, often diffuse unpleasant odors and, moreover, are known to be difficult to perfume. In fact very few perfumes are stable in such media. The present invention relates more particularly to a system for perfuming the headspace of aggressive liquid media, namely bleaches or bleach containing household products, contained in a bottle, such that the user smells a pleasant odor when opening the bottle or pouring the contents thereof, but no direct contact between the perfume and the medium occurs.

The difficulty to perfume aggressive media, in particular hypochlorite bleach-containing products (hereafter referred as "bleach"), is a well-known problem in the field of household cleaners. This problem has a double aspect: on the one hand, the perfume may be altered by the aggressive base, and on the other hand, the activity of the product, measured as the available chlorine content, can also be degraded as the result of the presence of perfuming ingredients susceptible of reacting with the hypochlorite ion.

A few attempts to circumvent the aforementioned drawbacks by perfuming the headspace in the container above the product have been published. For instance, U.S. Pat. No. 4,858,758 describes a container equipped with a closure capable of delivering perfume into the headspace above granular products such as solid bleach. In this device, the perfume is contained in an absorbent reservoir placed in the closure, said reservoir being faced with a perforated polymer coating. This facing allows the fragrance materials to macroscopically diffuse through the apertures. Clearly, this design is limited to use only with solid products. Moreover, the manufacture of this device is complicated by the requirement of perforations in the facing.

More recently, a device was proposed in EP 663 883-B1 which overcomes the limitation of product applicability of the aforementioned prior art, whilst relying on a distinct fragrance delivery system. EP 663 883 discloses a device comprising a compressible adsorbent material impregnated with perfume and lodged in the closure or cap of a container. In one embodiment, the material is faced with polyethylene to protect it from the aggressive medium held within the container. The device acts as both the sealing liner for the closure as well as a reservoir for the perfume. When the closure is tightened, the physical nature of the reservoir causes a dose of the fragrance to be excreted therefrom, by mechanical compression, into the headspace above the product. Despite the fact that this device can suit any kind of product stocked in a container (i.e. liquid or dry), the release of the perfume into the headspace relies on a mechanical action. In other words, the system needs external activation to be effective.

The present invention avoids the drawbacks of the above-mentioned prior art inventions by providing a device which makes it possible to efficiently perfume the headspace above both liquid and solid products. The perfume is effectively segregated from the aggressive medium, thus preserving the quality of its fragrance, whilst also preventing decomposition of the product housed in the container. Finally, no external activation is required for working the invention.

BRIEF DESCRIPTION OF THE INVENTION

We have now discovered that it is possible to perfume the headspace of a liquid composition stocked in a container, without requiring mechanical activation to cause dosing of the fragrance and without being limited to use with only solid products. Moreover, the user can perceive a pleasant scent when opening the container or pouring its contents, even when the latter have an unpleasant odor.

As previously mentioned, the present invention concerns a cap (1) for a container (2) housing a consumer product, comprising a device (7, 11) capable of diffusing a volatile substance inside said container, said device being formed of a cap liner element (8, 12) carrying the volatile substance and of a barrier element (10, 14) lodged between the cap liner element and the interior of the container, wherein said barrier element is formed of a membrane permeable to the vapors of the volatile substance and impermeable to the consumer product, so as to enable molecular diffusion of the volatile substance's vapors inside the closed container. The volatile substance's vapors can diffuse through the membrane, thus creating a perfumed headspace above the product, for example a cosmetic or cleaning composition contained in the closed container. The diffusion of the volatile substance through the membrane into the headspace of the container occurs on a molecular level, rather than, as disclosed in the prior art, being mechanically dosed or being released through macroscopic apertures. When the user removes the cap from the container, the perfume diffused above the active composition is released out of the bottle and perceived by the user. Unlike the usual consumer products of this type, wherein the composition itself is perfumed, the perfume, according to the present invention, is isolated from the product base.

As it will become more apparent upon reading the specific examples given hereinafter, the device according to the invention offers several advantages. In addition to the fact that the invention is particularly advantageous to mask bad odors, which can diffuse from compositions that cannot be easily perfumed when the user opens the container and pours its content, said device may be applied to both liquid and solid products, because the membrane present in the diffusing element lodged in the cap or closure of the container is permeable to the volatile substance carried by the cap liner member but does not contain apertures. The perfume or any other volatile substance can diffuse from its carrier to the headspace through the membrane permeable to volatiles, but the latter is impermeable to the liquid product, thus preventing the latter from contact with the perfume housed in the cap. Since the perfume is effectively segregated from the medium inside the container, the stability issues, such as loss of odor quality and reduction of bleach activity, normally associated with aggressive consumer product bases are not encountered. This will become apparent from the stability data presented in a comparative example hereinafter, which shows that the available chlorine level of a bleach product remains substantially constant with time when contained in a bottle provided with a cap or closure according to the invention.

Therefore, whereas currently only a handful of perfume raw materials are stable and can be used in chlorine bleaches, the present invention allows a greatly expanded selection of perfume materials, the latter being no longer limited by the nature of the base. On the other hand, the unpleasant odor of the unperfumed bleach product is still counteracted by means of the headspace volatiles accumulated inside the container and which are released upon opening the latter.

The cap according to the invention, and the container carrying such a cap are therefore particularly useful for consumer products such as liquid products for textile treatment, in particular those that cannot be easily perfumed, as well as all-purpose cleaners, bleaches, etc. However, it is clear that its utilization is not limited to the above-mentioned products, and the packaging equipped with a removable cap according to the invention can suit any other usual detergent application, such as fabric softeners or detergent compositions, or cleaning products for dishes or varied surfaces for domestic as well as industrial use. The system can also be used in other applications and traditionally perfumed products, namely hygiene, hair care, or hair coloring products.

Furthermore, although the invention is particularly adapted for the diffusion of perfumes inside bottles containing consumer products typically fragranced, the caps according to the invention can also be employed to achieve other effects, such as the diffusion of volatile agents like antibacterial, bactericide, insecticide, insect repellent agents or other volatile active substances.

According to one embodiment of the present invention, the element provided in the cap and capable of diffusing a volatile substance such as a perfume material is lodged inside the cap and serves as a cap liner. The cap liner is assembled with a membrane formed of a polymeric film affixed, by heating or another method, to the cap liner's surface facing the inside of the bottle, the liner being impregnated with a desired amount of perfume oil. The liner can be formed of any current cap liner material which is capable of being impregnated with one or more perfuming ingredients. The affixed film is solid, covers the entire face of the liner, and does not contain apertures. The polymer membrane allows diffusion of volatile materials on a molecular scale through it to the inside of the bottle so as to populate the headspace above the composition in the container with the volatile materials while not allowing the contents of the container to contact the perfume-impregnated liner material.

In another embodiment of the invention, the cap comprises a chamber in which the fragrance is housed. Said fragrance can be, for example, in liquid form. The chamber for the fragrance is provided with a polymeric film, the diffusion membrane, which acts as a semi-permeable barrier for allowing diffusion of the perfume volatiles into the container, whilst preventing any liquid contained in the bottle from affecting the cap liner and the perfume it carries.

According to the invention, the fragrance is diffused out of the cap liner element carrying the latter, through the membrane, into the headspace of the bottle on a molecular scale. The membrane does not require apertures for the diffusion, nor does the fragrance release require mechanical activation. When the bottle is opened, the user clearly perceives the fragrance volatiles accumulated above the liquid or solid contents of the bottle, and this fragrance is perceivable even after the bottle has been opened for several minutes. When the cap is replaced, the headspace above the liquid in the container is replenished with fragrance, since the diffusing element is active without mechanical activation, until all the perfume is exhausted.

These and other aspects of the invention shall become apparent from the drawings and description hereafter.

DETAILED DESCRIPTION OF THE INVENTION

Figure 1:
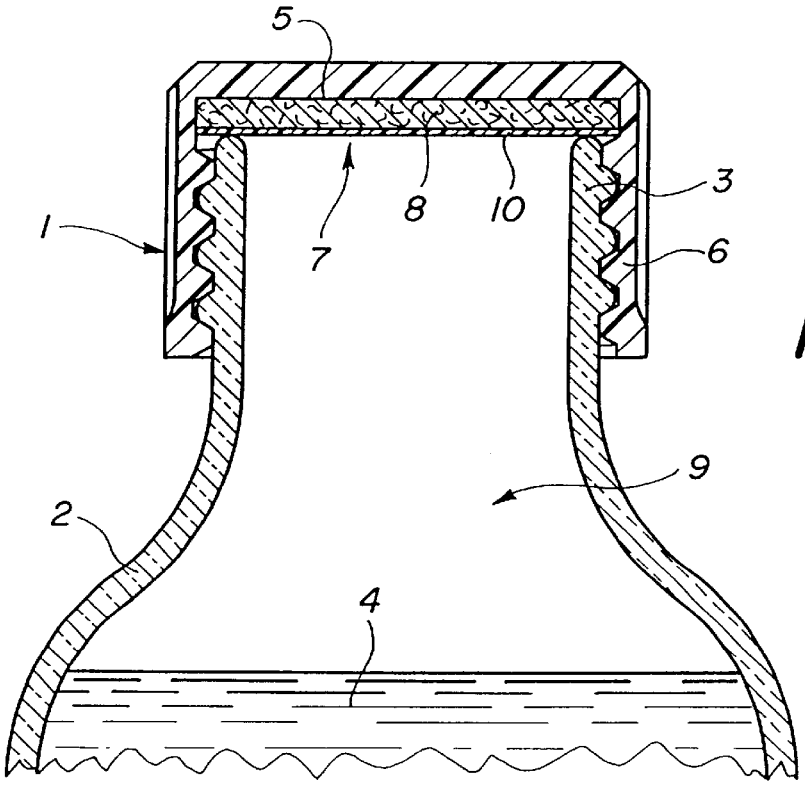
FIG. 1 is a vertical section of a container showing a bottle containing a liquid composition and having a removable cap according to the invention equipped with an element carrying a perfume, namely a cap liner element impregnated with a perfume and a polymeric diffusion film member affixed on one side of said liner.

Referring to the drawings, in FIG. 1 there is illustrated an embodiment of the invention, wherein a container is in the form of a bottle 2, having a threaded neck 3, and containing a liquid product 4 (as for example a detergent, all-purpose-cleaner, bleach, hair care or cosmetic base). The bottle is provided with a removable cap 1. This cap has an inside horizontal wall 5 overlying the neck 3 of the bottle. The depending skirt 6 has an internal threaded form which interfits with the neck of the bottle. As shown in FIG. 1, the skirt 6 and neck 3 have interfitting screw threads, but other types of interfitting shapes can be used. The bottle, neck, and cap may all consist of plastic or other materials.

Also provided is a device 7 comprising a cap liner 8, impregnated with a volatile substance by applying a fragrance oil onto the liner material. The cap liner 8 is directly carried by the cap of the bottle. For example, the cap liner, having a form adaptable to the inside of the cap, can be affixed therein by pressure and, thus, retained by friction strength. Other means of fixing the cap liner into the cap are possible, such as gluing, for example.

The material of the cap liner 8 can be common cardstock, paper, or any other cellulosic or polymeric material. Non limiting examples of the material employed for the cap liner are also polyethylene, polypropylene, polystyrene, polyacrylates, polyvinyl chlorides, polycarbonate, and fluoropolymers, as well as copolymers or blends thereof. Other appropriate materials are described for instance in U.S. Pat. No. 4,734,278, which discloses the use of perfumed polymeric resins essentially consisting of polyether-ester-amides, said materials thus providing volatile emitting bodies. Likewise, U.S. Pat. No. 5,780,527 discloses a gel element resulting from the in situ cross-linking of a functionalized liquid polymer, or a copolymer with a cross linking agent, in the presence of a perfume, deodorizing, or sanitizing bases. The functionalized polymers disclosed thereby are, in particular, derivatives of butadiene, isoprene, and chloroprene, such as maleinised polybutadiene or maleinised polyisoprene. These gelified elements provide diffusing elements which can suit the present invention. The contents of these patents and more particularly their teachings related to the polymeric materials thereby mentioned are hereby included by reference. Preferred cap liner materials are selected from the group consisting of cellulosic materials. The cap liner material is capable of supporting the perfume by way of absorbing or adsorbing the fragrance oil and it is in addition chemically and physically stable in the presence of the fragrance oil.

It is clear that there is no restriction on the material that can be used for the cap liner 8, as long as said material is capable of being impregnated with a volatile substance, in a desired amount, and is able to release said substance with time into the headspace region 9 above the product contained in the container 2 without any external activation by the user.

As shown in FIG. 1, the cap liner 8 is assembled with a polymeric diffusion film or membrane 10, which covers the surface of the cap liner facing the interior of the bottle, i.e. its surface which is not in contact with the cap and which prevents it from being splashed with the bleach or detergent product contained in the bottle. The polymeric membrane thus provides the molecular diffusion of the organic fragrance molecules through the film from the cap liner material to create the headspace of the unfilled portion of the bottle. The membrane is therefore molecularly permeable to the volatiles, but impermeable to liquids. Non-limiting examples of films potentially applicable in this technology are polyethylene, polypropylene, polystyrene, polyacrylates, polyvinyl chlorides, polycarbonate, and fluoropolymers, as well as copolymers or blends thereof. The membrane material can be selected preferably from the group consisting of polyethylene or polyethylene/ethyl acrylate copolymers. The film is chemically and physically stable in the presence of both the perfume and the substance contained in the bottle.

Figure 2:
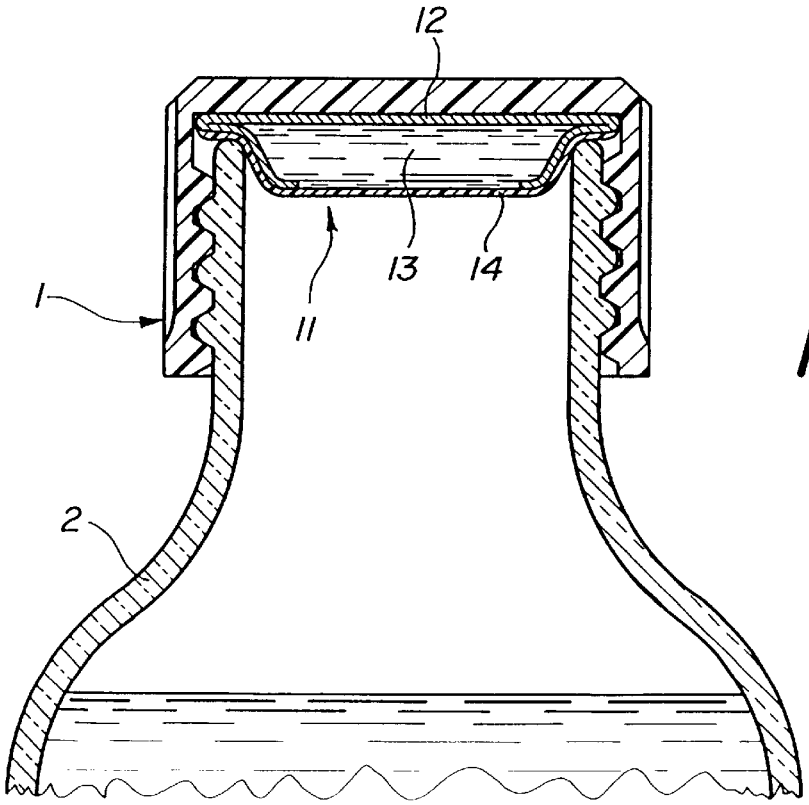
FIG. 2 is a vertical section of a removable cap in a second embodiment, namely wherein the element carrying the volatile substance is a chamber for housing the perfume, the latter being in liquid form.

In FIG. 2, the elements bearing the same numbers as in FIG. 1 are the same. FIG. 2 illustrates another embodiment of the invention wherein a fragrance carrying element 11 lodged in the removable cap 1 is in the form of a chamber having a wall affixed to, or in contact with, the internal surface of the cap. The chamber is shaped in a way suitable to be encased in the cap and may be adapted to the form of the latter. Its shape defines a housing or chamber having a certain volume to contain the perfume. The top wall 12 of this device 11 can be affixed to, or contacted with, the internal wall of the cap by means of adhesive, glue, or any other means. The chamber contains the fragrance oil 13 which can be in a liquid or solid form. In this embodiment, the wall of the housing facing the interior of the container when the cap is screwed on the bottle comprises, or is formed by, a semi-permeable membrane or film 14. The membrane is affixed on the surface of the chamber facing the interior of the bottle, so as to retain the active ingredient in the chamber whilst allowing its diffusion inside the bottle. At the same time, the membrane protects the active ingredient from splashing of the product contained in the bottle.

As to the volatile substances which are suitable active materials according to the invention, they are selected from the perfume ingredients or compositions currently used in the art to confer, enhance, or modify the odor properties of consumable materials. The expert perfumer knows by experience that the nature of such compounds or compositions varies as a function of the desired odor effect, and, thus, it is impossible to define here all active usable materials. These perfuming ingredients belong to varied chemical groups such as alcohols, aldehydes, ketones, esters, ethers, acetates, nitrites, terpenic hydrocarbons, or heterocyclic nitrogen- or sulfur-containing compounds, as well as natural or synthetic essential oils. Many of these ingredients are listed in reference texts such as S. Arctander, "Perfume and Flavor Chemicals", Montclair, N.J. (1969) or more recent versions thereof, or in other similar books.

The concentration of perfume used can vary in a wide range of values. Typically, for a current US Gallon bottle, the amount of fragrance necessary to impregnate the cap liner is from 0.001 to 10 g, more preferably 0.01 to 1.0 g, and most preferably 0.05 to 0.5 g of fragrance. This level provides a very strong odor from the headspace above the product. With the cap removed from the bottle the odor in the bottle remains strong for at least 5 minutes, and, upon reaffixing the cap, the device quickly replenishes the space above the product 4 to repeatedly provide the same effect.

In the embodiment as shown in FIG. 2, clearly the amount of perfume that can be used depends on the dimensions of the housing, the latter being also a function of the size of the cap. The skilled person can, therefore, adjust the amount of perfume as a function of these parameters.

The invention is illustrated in further detail by way of the following examples wherein the abbreviations have the meaning common in the art, and the temperatures are indicated in degrees centigrade.

EXAMPLE 1

A round piece of common cardstock of 3.5 cm of diameter and 1 mm of thickness was cut out. A round section with the same diameter was cut from a polyethylene/ethyl acrylate (15%) copolymer sheet. This film was then affixed to one face of the cardstock piece by heating with a common household iron, and the assembly was then allowed to cool to room temperature. The other face of the cardstock was then impregnated with 0.1 g of the following perfuming base by pipetting the fragrance oil onto the cardstock.

A perfuming composition I to be deposited on the cardstock was prepared by admixing the following ingredients:

COMPOSITION I

| Ingredients | Parts by weight |
|---|---|
| Aldehyde C 10 | 5 |
| Aldehyde C 9 | 2 |
| Allyl amyl glycolate | 10 |
| Allyl caproate | 7 |
| Allyl cyclohexylpropionate | 10 |
| Citral pure | 100 |
| Citrathal[1)] | 2 |
| Lemon essential oil | 297 |
| Orange terpenes | 10 |
| α-Damascone | 2 |
| Dihydromyrcenol[2)] | 250 |
| Geranyl nitrile[3)] | 120 |
| Linalol | 150 |
| Methylnonylacetaldahyde | 5 |
| Hedione ®[4)] | 20 |
| Zestover[5)] | 10 |
| Total | 1000 |

[1)]1,1-diethoxy-3,7-dimethyl-2,6-octadiene
[2)]origin: International Flavours & Fragrances Inc., USA
[3)]3,7-dimethyl-2,6-octatrienenitrile; origin: Firmenich SA, Geneva, Switzerland
[4)]methyl dihydrojasmonate; origin: Firmenich SA, Geneva, Switzerland
[5)]2,4-dimethyl-3-cyclohexen-1-carbaldehyde; origin: Firmenich SA, Geneva, Switzerland The element prepared by pipetting this composition onto the cardstock was lodged in a cap of 3.7 cm of diameter by simple pressure. The cap was screwed on the corresponding half gallon bottle filled to normal capacity with a bleach product. After approximately one hour, the headspace over the bleach contained in the bottle was perfumed. Therefore, when opening the bottle, the user could smell a pleasant lemon odor coming out of the bottle. The procedure was repeated with half gallon bottles filled to varying levels of bleach product.

EXAMPLE 2

An assembly of common cardstock and polymeric film similar to the assembly described in Example 1 was impregnated with the following perfuming base:

COMPOSITION II

| Ingredients | Parts by weight |
|---|---|
| Benzyldimethylcarbinol acetate | 120 |
| Coumarin | 20 |
| Damascenone | 4 |
| Ethylamylketone | 8 |
| Eucalyptol | 40 |
| Eugenol | 80 |
| Lavandin oil | 80 |
| Linalol | 160 |
| Methylhexylketone | 8 |
| 10% Methyl-p-cresol* | 4 |
| Hedione ®[1)] | 40 |
| Phenylethyl alcohol | 398 |
| Rose oxide | 8 |
| Styrallyl acetate | 60 |
| Terpineol | 120 |
| Terpinyl acetate | 270 |
| Undecavertol[2)] | 8 |
| Veloutone | 4 |
| Zestover[3)] | 8 |
| Total | 1400 |

*in dipropylene glycol
[1)]methyl dihydrojasmonate; origin: Firmenich SA, Geneva, Switzerland
[2)]4-methyl-3-decen-5-ol; origin: Givaudan-Roure SA, Vernier, Switzerland
[3)]2,4-dimethyl-3-cyclohexen-1-carbaldehyde; origin: Firmenich SA, Geneva, Switzerland The impregnated element assembled with the membrane was then placed in a cap as in Example 1. After approximately one hour, the headspace over the bleach contained in the bottle was diffusing a pleasant odour of lavender.

COMPARATIVE EXAMPLE

Titration of available chlorine in a classical unfragranced bleach composition was carried out in 3 different containers equipped with caps. The first bottle was a current packaging, and the second and third bottles were equipped with a cap according to the present invention, comprising an element supporting a perfume assembled with a semi-permeable membrane, inside the container. The caps of the second and third bottles were impregnated each with a different perfuming base, as described respectively in Examples 1 and 2.

Table 1 gives the measures made in the second (composition I), respectively the third bottle (composition II) of the percentage of available chlorine degradation of the bleach that was caused by the invention upon standard stability testing, i.e. the percentage degradation of available chlorine in excess with regard to the degradation in the first bottle which is not equipped with a cap according to the invention. The available chlorine concentrations were measured by titration after two and four weeks, at 3° and 40° C., and in full and ⅓-full bottles.

TABLE 1

Percentage degradation of available chlorine in excess of the unperfumed samples.

| | Available Chlorine Degradation in Excess of Unperfumed Sample (%) | | | | | | | |
|---|---|---|---|---|---|---|---|---|
| Volume | Full | | | | ⅓-Full | | | |
| Temp [° C.] | 3 | | 40 | | 3 | | 40 | |
| Time [weeks] | 2 | 4 | 2 | 4 | 2 | 4 | 2 | 4 |
| Composition I | 1.80 | 3.88 | 5.20 | 8.79 | 2.19 | 2.93 | 0.86 | 6.14 |
| Composition II | 0.98 | 0.10 | 3.57 | 4.91 | 0.01 | 0.01 | 1.74 | 0.76 |

Table 1 illustrates that the degradation available chlorine in the bleach contained in the bottles equipped with the caps of the invention was at most 8.8% higher than in the unperfumed regular bleach container. This figure is within the experimental error of the titration method. Therefore, for all practical purposes, there was no additional chlorine degradation in the containers according to the invention as compared to that occurring in the unperfumed bleach. For comparison purposes, the same fragrances, when solubilized into the bleach at a level of 0.02% using current solubilization techniques, caused 18–44% available chlorine degradation in excess of that measured in the unperfumed sample after only two weeks. This degradation was 16–39% greater than that caused by the invention.

What is claimed is:

1. The combination of a removable cap (1) and a container (2) that houses a consumer product, wherein the cap includes a volatile substance, and a device (7,11) for diffusing vapors of the volatile substance inside said container, said device being formed of a cap liner element (8,12) that carries the volatile substance and of a barrier element (10,14) lodged between the cap liner element and the interior of the container, wherein said device requires no mechanical activation, and the barrier element is formed of a membrane that does not have microscopic apertures and that is permeable to the vapors of the volatile substance but impermeable to the consumer products, so as to enable molecular diffusion of the volatile substance's vapors inside the closed container when the cap is used to close the container.

2. The combination according to claim 1, wherein said cap liner element (8,12) is formed of a material selected from the group consisting of cellulosic materials, polyethylene, polypropylene, polystyrene, polyacrylates, polyvinyl chlorides, polycarbonate, fluoropolymers and copolymers, blends or mixtures thereof, and wherein the volatile substance is selected from the group consisting of a perfuming ingredient or composition, antibacterial, bactericide, insecticide, and insect repellant agent.

3. The combination according to claim 1, wherein the membrane (10,14) is a polymeric film selected from the group of materials consisting of polyethylene, polypropylene, polystyrene, polyacrylates, polyvinyl chlorides, polycarbonate, fluoropolymers and copolymers or blends or mixtures thereof, and wherein the consumer product is a bleach, detergent, all purpose cleaner, hair care or cosmetic product.

4. The combination of a removable cap (1) and a container (2) that houses a consumer product, wherein the cap includes a device (7,11) for diffusing vapors of a volatile substance inside said container, said device being formed of a cap liner element (8,12) that carries the volatile substance and of a barrier element (10,14) lodged between the cap liner element and the interior of the container, wherein said device requires no mechanical activation, and the barrier element is formed of a membrane that does not have microscopic apertures and that is permeable to the vapors of the volatile substance but impermeable to the consumer product, so as to enable molecular diffusion of the volatile substance's vapors inside the closed container when the cap is used to close the container, and wherein said cap liner element (8,12) is a chamber housing (12) comprising the volatile substance (13) in liquid form.

5. The combination according to claim 4, wherein the volatile substance is selected from the group consisting of a perfuming ingredient or composition, antibacterial, bactericide, insecticide, and insect repellant agent.

6. The combination according to claim 4, wherein the membrane (10,14) is a polymeric film selected from the group of materials consisting of polyethylene, polypropylene, polystyrene, polyacrylates, polyvinyl chlorides, polycarbonate, fluoropolymers and copolymers, blends or mixtures thereof.

7. The combination according to claim 4, wherein the consumer product is a bleach, detergent, all purpose cleaner, hair care or cosmetic product.

8. A method to perfume the interior (9) of a container (1) housing a bodycare or homecare product, wherein the container includes a removable cap and a perfume is carried on a cap liner member of an element lodged in the cap of said container, said element also comprising a barrier member lodged between the cap liner element and the interior of the container, wherein the barrier element allows molecular diffusion of said volatile substance inside the container without requiring a mechanical activation when the cap is used to close the container, and wherein the barrier element is formed of a membrane that does not have microscopic apertures.

9. The method of claim 8, which further comprises forming said membrane of a material selected from the group consisting of polyethylene, polypropylene, polystyrene, polyacrylates, polyvinyl chlorides, polycarbonate, fluoropolymers and copolymers, blends or mixtures thereof.

10. The method of claim 8 which further comprises selecting the volatile substance from the group consisting of a perfuming ingredient or composition, antibacterial, bactericide, insecticide, and insect repellant agent.

11. The method of claim 8, wherein the consumer product is a bleach, detergent, all purpose cleaner, hair care or cosmetic product.

* * * * *